US006148834A

United States Patent [19]

Grooms, Sr.

[11] Patent Number: 6,148,834

[45] Date of Patent: Nov. 21, 2000

[54] MODULAR TENT PLATFORM SYSTEM

[76] Inventor: Tally R. Grooms, Sr., P.O. Box 812, Gray Ct., S.C. 29645

[21] Appl. No.: 09/345,851

[22] Filed: Jul. 1, 1999

[51] Int. Cl.[7] ..... E04H 15/56; E04F 15/00; F16B 1/00; B65D 19/38

[52] U.S. Cl. ..... 135/116; 52/668; 403/387; 248/346.5

[58] Field of Search ..... 135/116, 119, 135/120.3, 120.1, 137, 91, 93; 52/262, 506.06, 668, 666, 588.1, 590.1, 578; 248/346.3, 346.5; 703/387, 384, 386

[56] References Cited

U.S. PATENT DOCUMENTS 5,615,521 4/1997 Simerka ..... 135/116 X
5,660,197 8/1997 Boe et al. ..... 135/116

*Primary Examiner*—Robert W. Gibson, Jr.
*Assistant Examiner*—Erica B. Harris

[57] ABSTRACT

A modular tent platform system for elevating a tent structure from a ground surface to enhance comfort within the tent structure and prevent saturation of the tent structure due to ground moisture, runoff, or precipitation includes substantially planar support panels, support braces, support legs for interlocking adjacent support panels, and attachment assemblies for securing a tent to the platform. In a preferred embodiment, the support legs and adjacent panels are coupled together using channeled connecting members.

10 Claims, 3 Drawing Sheets

MODULAR TENT PLATFORM SYSTEM

BACKGROUND OF THE INVENTION

1. Field of the Invention

The present invention relates to floor systems and more particularly pertains to a new modular tent platform system for elevating a tent structure from a ground surface to enhance comfort within the tent structure and prevent saturation of the tent structure due to ground moisture, runoff, or precipitation.

2. Description of the Prior Art

The use of floor systems is known in the prior art. More specifically, floor systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,546,720; 4,305,414; 5,295,341; 5,052,158; 3,441,037; and 1,533,074.

While these devices fulfill their respective, particular objectives and requirements, the aforementioned patents do not disclose a new modular tent platform system. The inventive device includes planar support panels, support braces, support legs for interlocking adjacent support panels, and attachment assemblies for securing a tent to the platform.

In these respects, the modular tent platform system according to the present invention substantially departs from the conventional concepts and designs of the prior art, and in so doing provides an apparatus primarily developed for the purpose of elevating a tent structure from a ground surface to enhance comfort within the tent structure and prevent saturation of the tent structure due to ground moisture, runoff, or precipitation.

SUMMARY OF THE INVENTION

In view of the foregoing disadvantages inherent in the known types of floor systems now present in the prior art, the present invention provides a new modular tent platform system construction wherein the same can be utilized for elevating a tent structure from a ground surface to enhance comfort within the tent structure and prevent saturation of the tent structure due to ground moisture, runoff, or precipitation.

The general purpose of the present invention, which will be described subsequently in greater detail, is to provide a new modular tent platform system apparatus and method which has many of the advantages of the floor systems mentioned heretofore and many novel features that result in a new modular tent platform system which is not anticipated, rendered obvious, suggested, or even implied by any of the prior art floor systems, either alone or in any combination thereof.

To attain this, the present invention generally comprises planar support panels, support braces, support legs for interlocking adjacent support panels, and attachment assemblies for securing a tent to the platform.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new modular tent platform system apparatus and method which has many of the advantages of the floor systems mentioned heretofore and many novel features that result in a new modular tent platform system which is not anticipated, rendered obvious, suggested, or even implied by any of the prior art floor systems, either alone or in any combination thereof.

It is another object of the present invention to provide a new modular tent platform system that may be easily and efficiently manufactured and marketed.

It is a further object of the present invention to provide a new modular tent platform system that is of a durable and reliable construction.

An even further object of the present invention is to provide a new modular tent platform system which is susceptible of a low cost of manufacture with regard to both materials and labor, and which accordingly is then susceptible of low prices of sale to the consuming public, thereby making such modular tent platform system economically available to the buying public.

Still yet another object of the present invention is to provide a new modular tent platform system which provides in the apparatuses and methods of the prior art some of the advantages thereof, while simultaneously overcoming some of the disadvantages normally associated therewith.

Still another object of the present invention is to provide a new modular tent platform system for elevating a tent structure from a ground surface to enhance comfort within the tent structure and prevent saturation of the tent structure due to ground moisture, runoff, or precipitation.

Yet another object of the present invention is to provide a new modular tent platform system which includes planar support panels, support braces, support legs for interlocking adjacent support panels, and attachment assemblies for securing a tent to the platform.

Still yet another object of the present invention is to provide a new modular tent platform system that elevates the tent structure from the ground to permit comfortable placement of the tent on uneven terrain.

Even still another object of the present invention is to provide a new modular tent platform system that provides perforated support braces and legs to permit water to flow beneath a tent without saturating the tent.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
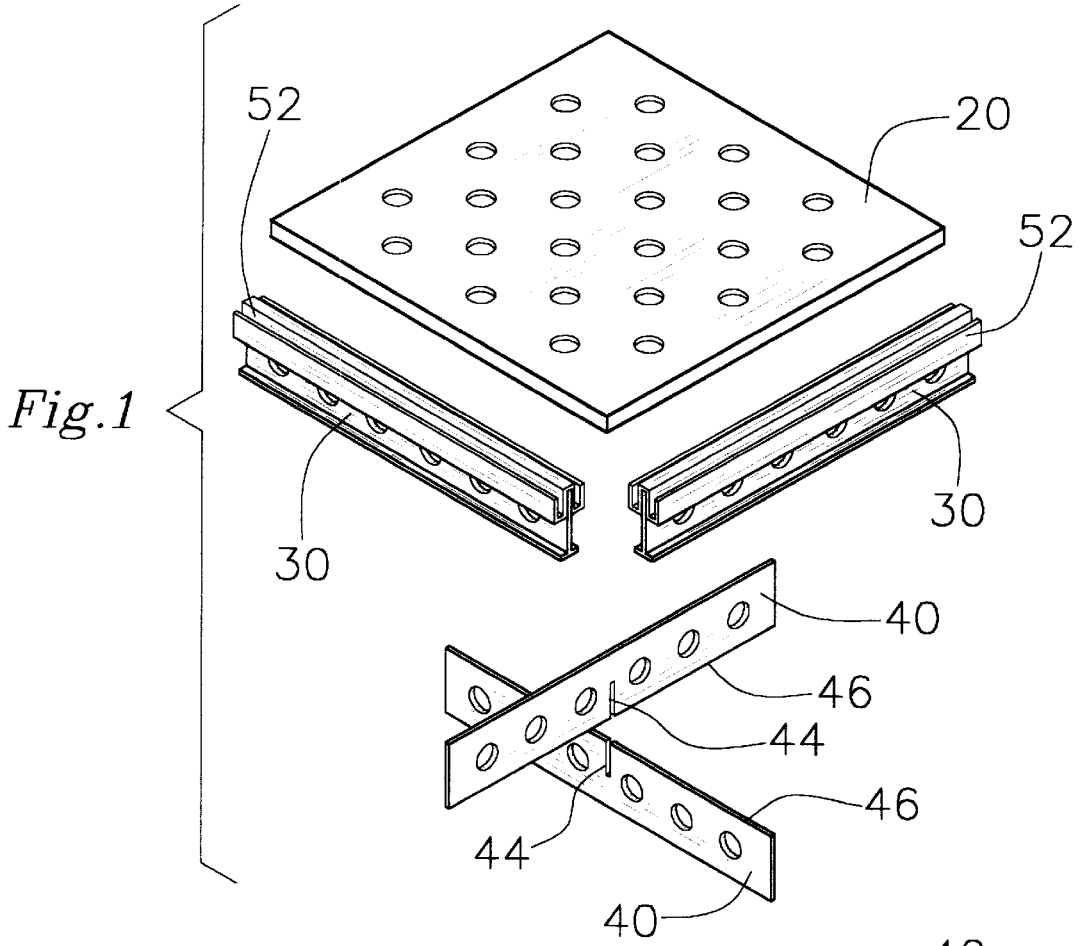
FIG. 1 is a perspective view of a new modular tent platform system according to the present invention.

With reference now to the drawings, a new modular tent platform system embodying the principles and concepts of the present invention and generally designated by the reference numeral 10 will be described.

Figure 2:
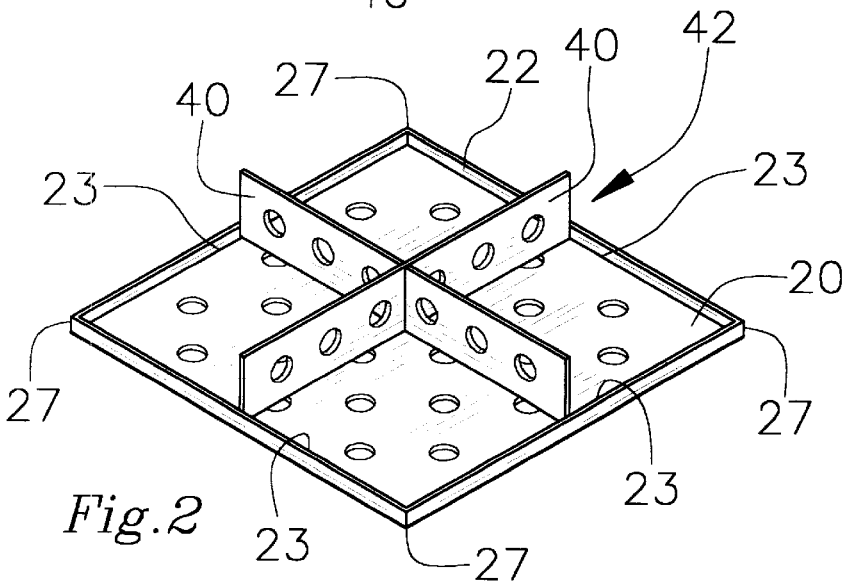
FIG. 2 is a perspective view of the underside of the present invention.
Figure 3:
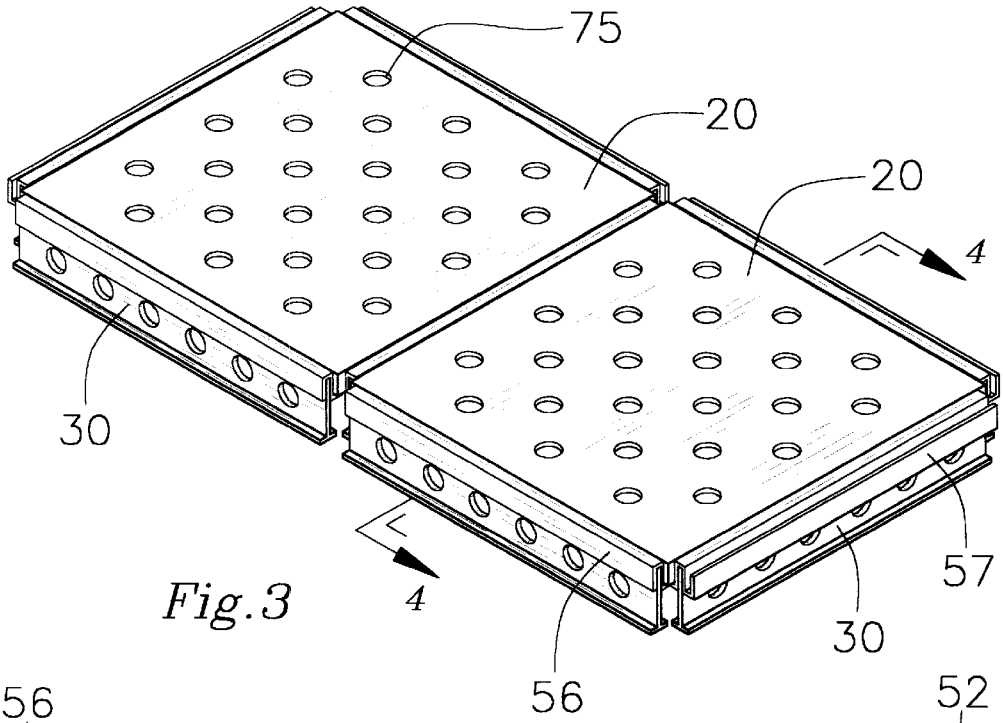
FIG. 3 is perspective view of the present invention.
Figure 4:
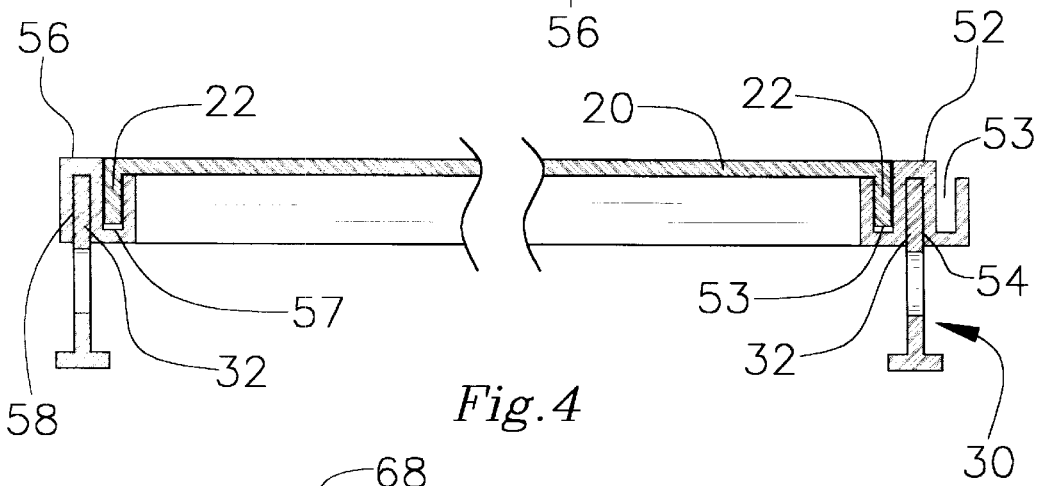
FIG. 4 is a cross-sectional view of the present invention taken along line 4—4 of FIG. 3.
Figure 5:
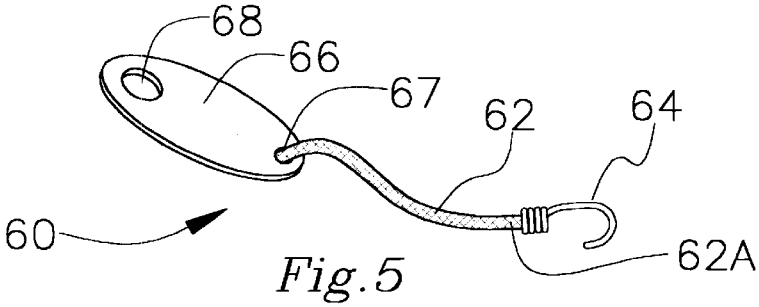
FIG. 5 is a perspective view of the tent attachment assembly of the present invention.
Figure 6:
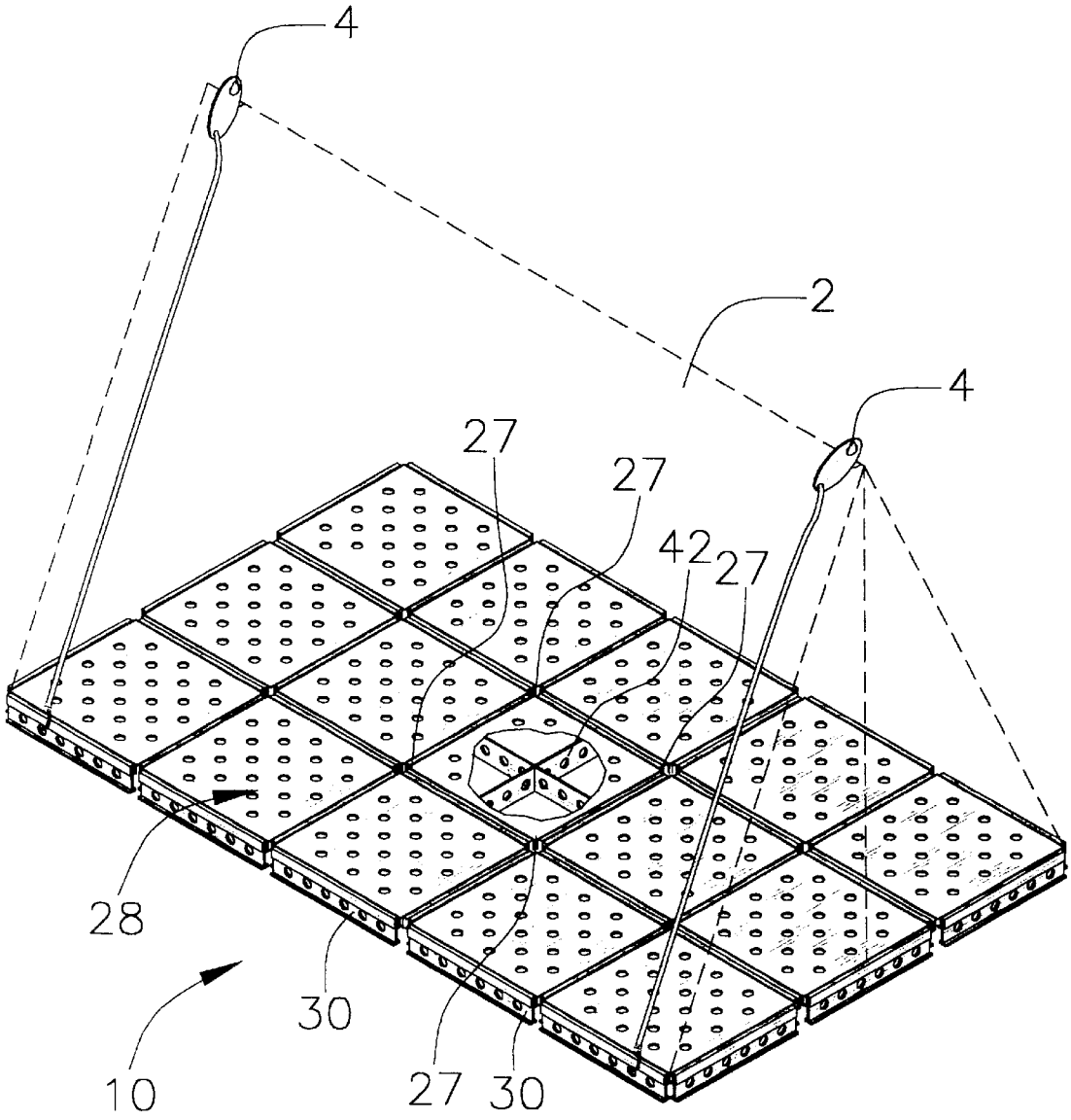
FIG. 6 is a perspective view of the present invention.

As best illustrated in FIGS. 1 through 6, the modular tent platform system 10 generally comprises substantially planar platform members 20, support legs 30, support braces 40, platform connecting members for coupling the support legs 30 to the platform members 20, and tent attachment assemblies 60 for attaching a tent 2 to the platform system 10.

Each platform member 20 has a platform lip 22 extending outwardly from a periphery of the platform member 20. The platform members 20 are configurable to form a platform 28 designed for positioning a tent 2 thereon.

The platform 28 is supported in spaced relationship over a ground surface by support legs 30 and support braces 40. Each support leg 30 is attached between adjacently positioned pairs of the platform members 20. All connections between adjacent platform members such as 20 employ an inter-platform connecting member 52 for coupling one of the support legs 30 to the platform members 20. Each of the inter-platform connecting members has a pair of outer channels 53 facing in a first direction and a central channel 54 facing in an opposite direction from the outer channels 53. The central channel 54 is positioned between the pair of outer channels 53 and each outer channel 53 is designed to receive the lip 22 of a respective platform member 20 therein. The central channel 54 is designed to receive a central flange 32 of a respective one of the support legs 30. Thus, the support leg 30 is coupled between the pair of adjacent platform panels 20.

The periphery of the platform 28 is supported by employing edge connecting members 56. Each edge connecting member 56 is designed for coupling one of the support legs 30 to an outer edge of one of the plurality of platform members 20 that forms the peripheral edge of the platform 28. Each of the edge connecting members 56 has a pair of adjacently positioned edge connector channels 57 and 58. Edge connector channel 57 is designed to receive the lip 22 of the platform member 20 therein and edge connector channel 58 is designed to receive the central flange 32 of a respective one of the support legs 30 therein. Thus, the support leg 30 is coupled to the peripheral edge of the platform 28.

Each support brace 40 is joinable to an associated second support brace 40 to form a cross-shaped interior support member 42. Each cross-shaped interior support member is then positionable beneath a respective one of the plurality of platform members 20 to provide support across the bottom of the platform member 20. Each of the support braces 40 includes a connecting slot 44 extending inwardly from a longitudinal edge 46 of the support brace 40. The connecting slot 44 extends into the support brace 40 a distance equal to one half of a lateral width of the support brace 40. Thus, a pair of the support braces 40 are positionable such that the connecting slot 44 of each support brace 40 receives the other support brace 40 therein and the pair of support braces 40 are configured into the cross-shaped interior support member 42.

In alternate embodiments the length of each support brace 40 is equal to either a lateral width of the platform members 20 or a diagonal length between opposite corners of the platform members 20. Each of the cross-shaped interior support members 42 is then positionable such that each support brace 40 either extends perpendicularly between respective midpoints of opposite sides 23 of said respective platform member 20 or extends diagonally between opposite corners 27 of the respective platform member 20 depending on the length of the support brace 40.

It is most preferred that the support legs 30, the support braces 40 and the platform members 20 all include perforations 75 designed to permit fluids to pass through the support legs 30, the support braces 40 and the platform members 20. Thus ground water is permitted to pass beneath a tent 2 supported above the ground by the platform 28. Additionally, air flow is permitted beneath the tent 2 to enhance fresh air to the tent 2 and enhance comfort inside the tent 2.

The tent attachment assemblies 60 are designed for securing the tent 2 to the platform 28. Each the tent attachment assembly has a longitudinally elastic flexible cord 62, a hook member 64, and a tab 66 for attaching to a tent post 4. Each hook member 64 is attached to a first end 62A of the cord 62 and is positionable for selectively attaching the cord 62 to any one of the perforations 75 in the support legs 30 or platform members 20. Each tab 66 has a pair of apertures 67 and 68 positioned at opposite ends of the tab 66. The aperture 67 is sized only slightly wider than a diameter of the cord 62 to permit the cord 62 to pass therethrough. The end of the cord 62 can then be tied to attach the cord 62 to the tab 66. Aperture 68 is designed for receiving a tent post 4 of the tent 2 therethrough such that tension in the elastic cord 62 holds the tent 2 to the platform 28.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A platform system for a tent, the platform system comprising:

a plurality of substantially planar platform members, each platform member having a platform lip extending outwardly from a periphery thereof, said plurality of platform members being configurable to form a platform adapted for positioning a tent thereon;

a plurality of support legs, each support leg being couplable between adjacently positioned pairs of said platform members; and a plurality of support braces, each support brace being couplable to another one of said support braces to form a crossshaped interior support member positionable beneath a selectable one of said plurality of platform members.

2. The platform system of claim 1, further comprising:

each of said plurality of support braces being perforated such that each support brace is adapted for permitting a fluid to pass through said support brace.

3. The platform system of claim 1, further comprising:

a plurality of inter-platform connecting members for coupling one of said support legs between one of said adjacently positioned pairs of said platform members, each of said inter-platform connecting members having a pair of outer channels facing in a first direction and a central channel facing in a second direction opposite said first direction, said central channel being positioned between said pair of outer channels, each outer channel being configured to receive said lip of a respective platform member therein, said central channel being configured to receive a central flange of a respective one of said support legs therein whereby said support leg is coupled between said pair of adjacent platform panels.

4. The platform system of claim 1, further comprising:

a plurality of edge connecting members, each edge connecting member being for coupling one of said support legs to an outer edge of one of said plurality of platform members forming a peripheral edge of said platform, each of said edge connecting members having a pair of adjacently positioned edge connector channels, one of said edge connector channels being configured to receive said lip of a respective platform member therein, the other of said pair of edge connector channels being configured to receive a central flange of a respective one of said support legs therein whereby said support leg is coupled to said peripheral edge of said platform.

5. The platform system of claim 1, further comprising:

each of said support braces having a connecting slot extending inwardly from a longitudinal edge of said support brace, said connecting slot extending into said support brace one half of a lateral width of said support brace, whereby a pair of said support braces is positionable such that the connecting slot of each support brace of the pair of support braces receives the other support brace therein whereby the pair of support braces are configured into said cross-shaped interior support member.

6. The platform system of claim 1, further comprising:

each said platform member being perforated such that said platform member is adapted to permit a fluid to pass through said platform member.

7. The platform system of claim 1, further comprising:

each of said interior support members further being positionable such that each support brace extends perpendicularly between respective midpoints of opposite sides of said respective platform member.

8. The platform system of claim 1, further comprising:

each of said plurality of support legs being perforated such that each support leg is adapted for permitting a fluid to pass through said support leg.

9. The platform system of claim 8, further comprising:

a plurality of tent attachment assemblies, each tent attachment assembly adapted for securing the tent to said platform, each said tent attachment assembly having a longitudinally elastic flexible cord having a first end and a second end;

each cord having a hook member coupled to said first end of said cord, said hook member being positionable for selectively attaching said cord to one of said perforations in said support legs, said hook member further being positionable for selectively attaching said hook member to one of said perforations in said platform members; and each cord having a tab coupled to said second end of said cord, said tab having an aperture adapted for receiving a tent post of the tent therethrough whereby said tent attachment assembly couples said tent to said platform.

10. A platform system for a tent, the platform system comprising:

a plurality of substantially planar platform members, each platform member having a platform lip extending outwardly from a periphery of each said platform member, said plurality of platform members being configurable to form a platform adapted for positioning a tent thereon;

a plurality of support legs, each support leg being couplable between adjacently positioned pairs of said platform members such that said pair of platform members are adapted for positioning in spaced relationship to the ground surface;

a plurality of support braces, each support brace being couplable to another one of said support braces to form a cross-shaped interior support member, each cross-shaped interior support member being positionable beneath a respective one of said plurality of platform members;

each of said plurality of support braces being perforated such that each support brace is adapted for permitting a fluid to pass through said support brace;

a plurality of inter-platform connecting members for coupling one of said support legs between one of said adjacently positioned pairs of said platform members, each of said inter-platform connecting members having a pair of outer channels facing in a first direction and a central channel facing in a second direction opposite said first direction, said central channel being positioned between said pair of outer channels, each outer channel being configured to receive said lip of a respective platform member therein, said central channel being configured to receive a central flange of a respective one of said support legs therein whereby said support leg is coupled between said pair of adjacent platform panels;

a plurality of edge connecting members, each edge connecting member being for coupling one of said support legs to an outer edge of one of said plurality of platform members forming a peripheral edge of said platform, each of said edge connecting members having a pair of adjacently positioned edge connector channels, one of said edge connector channels being configured to receive said lip of a respective platform member therein, the other of said pair of edge connector channels being configured to receive a central flange of a respective one of said support legs therein whereby said support leg is coupled to said peripheral edge of said platform;

each of said support braces having a connecting slot extending inwardly from a longitudinal edge of said support brace, said connecting slot extending into said support brace one half of a lateral width of said support brace, whereby a pair of said support braces is positionable such that the connecting slot of each support brace of the pair of support braces receives the other support brace therein whereby the pair of support braces are configured into said cross-shaped interior support member;

each said platform member being perforated such that said platform member is adapted to permit a fluid to pass through said platform member;

a plurality of tent attachment assemblies, each tent attachment assembly adapted for securing the tent to said platform, each said tent attachment assembly having a longitudinally elastic flexible cord having a first end and a second end;

each cord having a hook member coupled to said first end of said cord, said hook member being positionable for selectively attaching said cord to one of said perforations in said support legs, said hook member further being positionable for selectively attaching said hook member to one of said perforations in said platform members; and each cord having a tab coupled to said second end of said cord, said tab having an aperture adapted for receiving a tent post of the tent therethrough whereby said tent attachment assembly couples said tent to said platform.

* * * * *